US005454308A

United States Patent [19]

Sato et al.

[11] Patent Number: 5,454,308

[45] Date of Patent: Oct. 3, 1995

[54] CAM MECHANISM FOR STENCIL DUPLICATING MACHINE

[75] Inventors: Takuo Sato, Natori; Keiichi Chiba, Iwanuma, both of Japan

[73] Assignee: Tohoku Ricoh Co., Ltd., Miyagi, Japan

[21] Appl. No.: 199,942

[22] Filed: Feb. 22, 1994

[30] Foreign Application Priority Data

| | | | |
|---|---|---|---|
| Feb. 23, 1993 | [JP] | Japan | 5-033710 |
| Feb. 24, 1993 | [JP] | Japan | 5-035866 |
| Feb. 25, 1993 | [JP] | Japan | 5-037094 |

[51] Int. Cl.[6] ..... B41L 13/04

[52] U.S. Cl. ..... 101/116; 101/119; 101/120

[58] Field of Search ..... 101/116–120, 123, 101/124

[56] References Cited

U.S. PATENT DOCUMENTS

| | | | |
|---|---|---|---|
| 4,628,813 | 12/1986 | Hasegawa et al. . | |
| 5,172,632 | 12/1992 | Kobayashi et al. | 101/120 |
| 5,251,566 | 10/1993 | Kobayasi et al. . | |

FOREIGN PATENT DOCUMENTS

| | | |
|---|---|---|
| 59-59361 | 4/1984 | Japan . |
| 61-262125 | 11/1986 | Japan . |
| 4-11812 | 3/1992 | Japan . |

*Primary Examiner*—Edgar S. Burr
*Assistant Examiner*—Lynn D. Hendrickson
*Attorney, Agent, or Firm*—Oblon, Spivak, McClelland, Maier & Neustadt

[57] ABSTRACT

A reliable, small and light stencil duplicating machine comprises a printing section, a sheet feeding section, and a sheet discharging section. The printing section includes a printing drum for wrapping a stencil thereon, a press roller and parts associated with a printing process. The sheet feeding section feeds each printing sheet into a space between the printing drum and the press roller. A printed sheet is stripped off from the printing drum by a sheet separating member of the sheet discharging section, and is discharged onto a tray.

14 Claims, 9 Drawing Sheets

CAM MECHANISM FOR STENCIL DUPLICATING MACHINE

BACKGROUND OF THE INVENTION

1. Field of the Invention

This invention relates to a stencil duplicating machine, and more particularly to stencil duplicating machine which includes a mechanism for contacting and detaching a press roller with and from a printing drum, and a mechanism for actuating a sheet separating pawl to separate a printed sheet from the printing drum.

2. Description of the Related Art

There is a conventional stencil duplicating machine which uses a mechanism for contacting and detaching a press roller with and from a printing drum without interfering with a stencil clamp (called "clamp" hereinafter) mounted on the printing drum. Such a mechanism includes a pair of cams which are fitted on a shaft separate from a shaft for the printing drum, and actuates the press roller in synchronization with the printing drum.

Japanese Utility Model Laid-Open Publication No. Sho 59-59361 exemplifies an improved mechanism for contacting and detaching a press roller with and from a printing drum. Specifically, the mechanism is integral with the printing drum and includes a pair of cam discs for the press roller which are coaxially attached to the printing drum. The phase of these cam discs is determined in such a manner that the press roller is in contact with the printing drum while the press roller is in contact with base circles of these cam discs via a pair of rollers as cam followers, and that the press roller is out of contact from the printing drum while it is in contact with large diameter portions of the cam discs via these rollers. During the contact with the base circles of the cam discs, the press roller is not interfered with the clamp.

Japanese Patent Laid-Open Publication No. Sho 61-262, 125, for example, discloses a mechanism for preventing a sheet separating pawl from being interfered with a clamp in a stencil duplicating machine. During a non-sheet separating process, this mechanism allows the sheet separating pawl to stay at a position centrifugally away from the surface of a printing drum without interfering with the clamp. Such a position is called "second non-sheet separating position" (a first non-sheet separating position will be described later).

In this mechanism, a cam which is disposed on one side of the printing drum and also serves as a flange comes into contact with a cam follower which is disposed at one end of an arm for actuating the sheet separating pawl, thereby operating the sheet separating pawl. Further, the mechanism includes a lever, which is used to adjust a space between the surface of the printing drum and a tip of the sheet separating pawl, and is coaxial with the sheet separating pawl. This mechanism enables the sheet separating pawl to strip a printed sheet from the surface of the printing drum without contacting therewith even when the printing drum is not completely circular or even when the printing drum vibrates. In other words, at the sheet separating position, the sheet separating pawl always maintains a predetermined Space between the printing drum and itself.

Further, there have been proposed various methods of actuating the sheet separating pawl, e.g. a method of actuating the sheet separating pawl by using a cam which is mounted on a shaft independent of the shaft of the printing drum but is operated in synchronization with the printing drum, or a method in which an arm for the sheet separating pawl is actuated at a proper timing.

In the first mentioned mechanism, the press roller is prone to a problem that it does not always contact with the printing drum with a uniform pressure. In the second mentioned mechanism, little consideration is taken to units for pushing and supporting the press roller.

As for the sheet separating pawl actuating mechanism, the first mentioned mechanism is prone to the following problems should it be applied to a small stencil duplicating machine including a slender printing drum only for A4 size sheets. The stencil duplicating machine includes a strip of screen leather adjacent to a clamp on the surface of the printing drum. The screen leather reinforces the trailing edge of a mesh screen of the printing drum, projects approximately 1 to 2 millimeters from the printing drum, and is approximately 40 to 50 millimeters wide. Therefore, it is necessary to determine the size and contact timing of cams for the sheet separating pawl so as to keep the sheet separating pawl at a position where it is not in contact with the screen leather. This position is called "first non-sheet separating position". In the mechanism, the cams and cam followers are required to be in contact with one another over a relatively large area of the printing drum during the rotation of the printing drum. The sheet separating pawl has to quickly return to the sheet separating position via the first and second non-sheet separating positions in succession. A timing to set the sheet separating pawl at the first non-sheet separating position can be easily determined. Conversely, a timing to let the pawl return to the sheet separating position from the second non-sheet separating position is rather difficult since the tip of the separating pawl might collide with the clamp while the sheet separating pawl returns to the sheet separating position. The second timing cannot be set unless the cams are enlarged.

The second mentioned sheet separating mechanism inevitably becomes large since it has a complicated structure to operate the printing drum and associated cam shafts in a synchronized manner. Such a complicated structure requires deliberate and time-consuming adjustment, and would lead to a reduced performance of the stencil duplicating machine.

SUMMARY OF THE INVENTION

It is therefore an object of the invention to provide a reliable, small and light stencil duplicating machine, which includes a relatively small printing drum, enables a press roller to be in contact with the printing drum with a uniform pressure. In the stencil duplicating machine, a simplified sheet separating mechanism precisely sets timings to assure a quick return of a sheet separating pawl to the sheet separating position via first and second non-sheet separating positions.

In a first embodiment of the invention, there is provided a stencil duplicating machine comprising: a printing drum for wrapping a stencil thereon; a press roller selectively movable between a printing position in pressure contact with the printing drum via a printing sheet and a non-printing position away from the printing drum; a press roller arm for rotatably supporting opposite ends of the press roller, the press roller arm performing a rocking motion; at least one cam substantially integral with a side of the printing drum, the cam being coaxially supported on a center shaft of the printing drum, having a large diameter portion at a part thereof, and selectively displacing the press roller at the printing position and non-printing position; at least one press roller cam follower fitted on a press roller shaft, the press roller cam follower following the cam; a sheet separating member for stripping a printed sheet off from the surface of the printing drum; and a member for urging the press roller cam follower toward the cam.

According to a further aspect of the invention, there is provided a stencil duplicating machine comprising: a printing drum for wrapping a stencil thereon; a press roller selectively movable between a printing position in pressure contact with the printing drum via a printing sheet and a non-printing position away from the printing drum; a press roller arm for rotatably supporting opposite ends of the press roller, the press roller arm performing a rocking motion; a sheet separating pawl selectively movable between a sheet separating position to strip a printed sheet from the outer surface of the printing drum and a non-sheet separating position away from the printing drum; a shaft for fixedly supporting a base of the sheet separating pawl and moving the sheet separating pawl between the sheet separating position and the non-sheet separating position; an arm for selectively displacing the sheet separating pawl at the sheet separating position and the non-sheet separating position, the arm being fitted on the shaft for the sheet separating pawl; at least one cam substantially integral with a side of the printing drum, the cam being coaxially supported on a center shaft of the printing drum, having a large diameter portion at a part thereof, and selectively displacing the press roller at the printing position and non-printing position; at least one press roller cam follower following the cam, the cam follower being fitted on a press roller shaft; a member for urging the press roller cam follower toward the cam; a cam follower for the sheet separating pawl, the cam follower being fitted on the sheet separating pawl arm and following the cam; and a member for urging the sheet separating pawl cam follower toward the cam.

BRIEF DESCRIPTION OF THE DRAWINGS

In all Figures, identical parts have identical reference numbers.

DETAILED DESCRIPTION OF THE PREFERRED EMBODIMENTS

Figure 1:
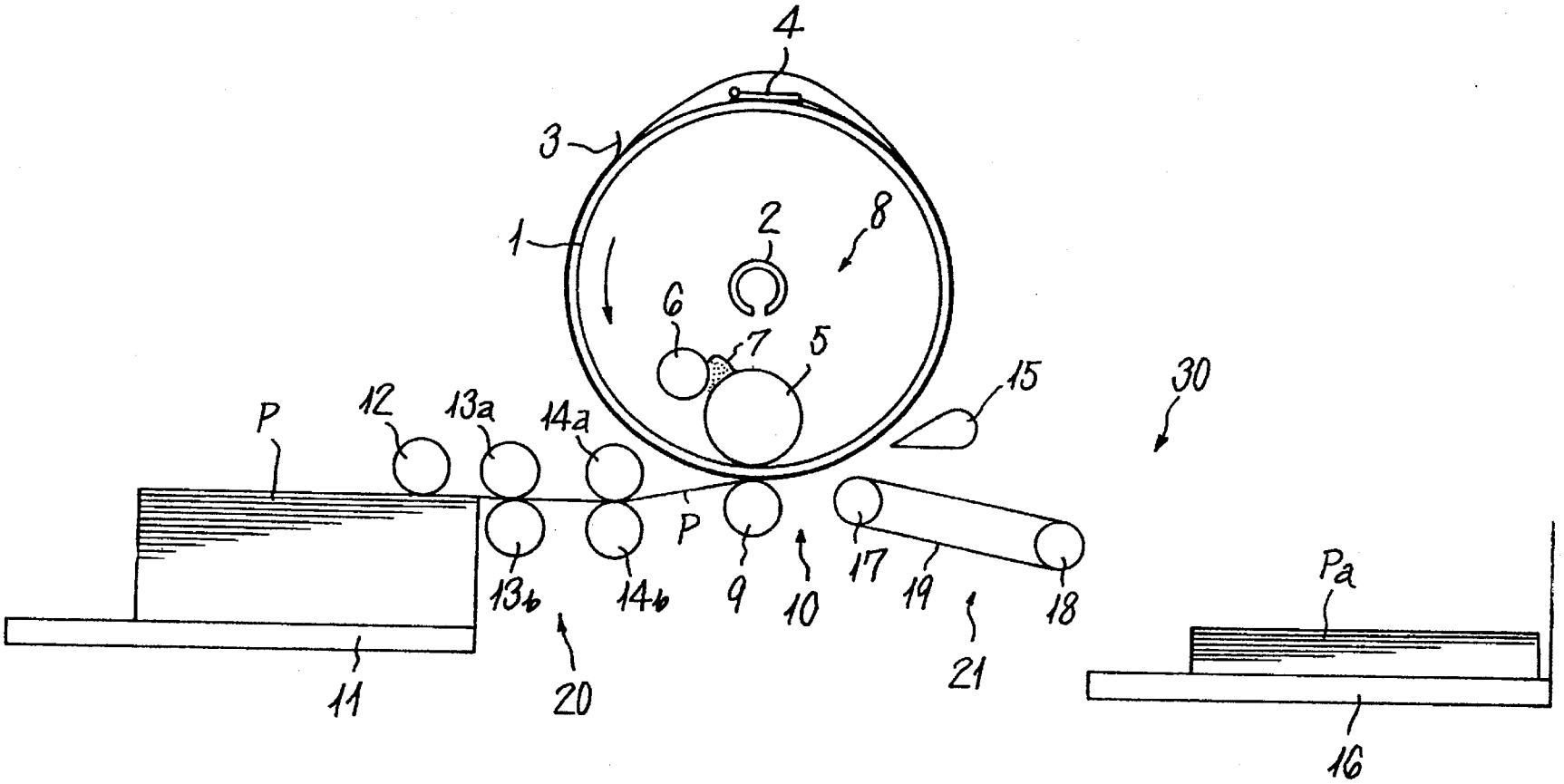
FIG. 1 is a schematic view showing the configuration of a stencil duplicating machine to which the present invention is applicable.

The configuration and operation of the stencil duplicating machine will be described with reference to preferred embodiments shown in the drawing figures.

The main part of the stencil duplicating machine is disposed at a center of a housing (not shown). Referring to FIG. 1, the stencil duplicating machine comprises a printing section 10, a sheet feeding section 20, and a sheet discharging section 30. The printing section 10 mainly includes a cylindrical printing drum 1 which carries a stencil 3 wrapped on the outer surface thereof. The sheet feeding section 20 is disposed at a left position under the printing drum 1 so as to feed printing sheets P to the printing drum 1. The sheet discharging section 30 is located opposite to the sheet feeding section 20 and discharges printed sheets Pa onto a tray 16.

Figure 3:
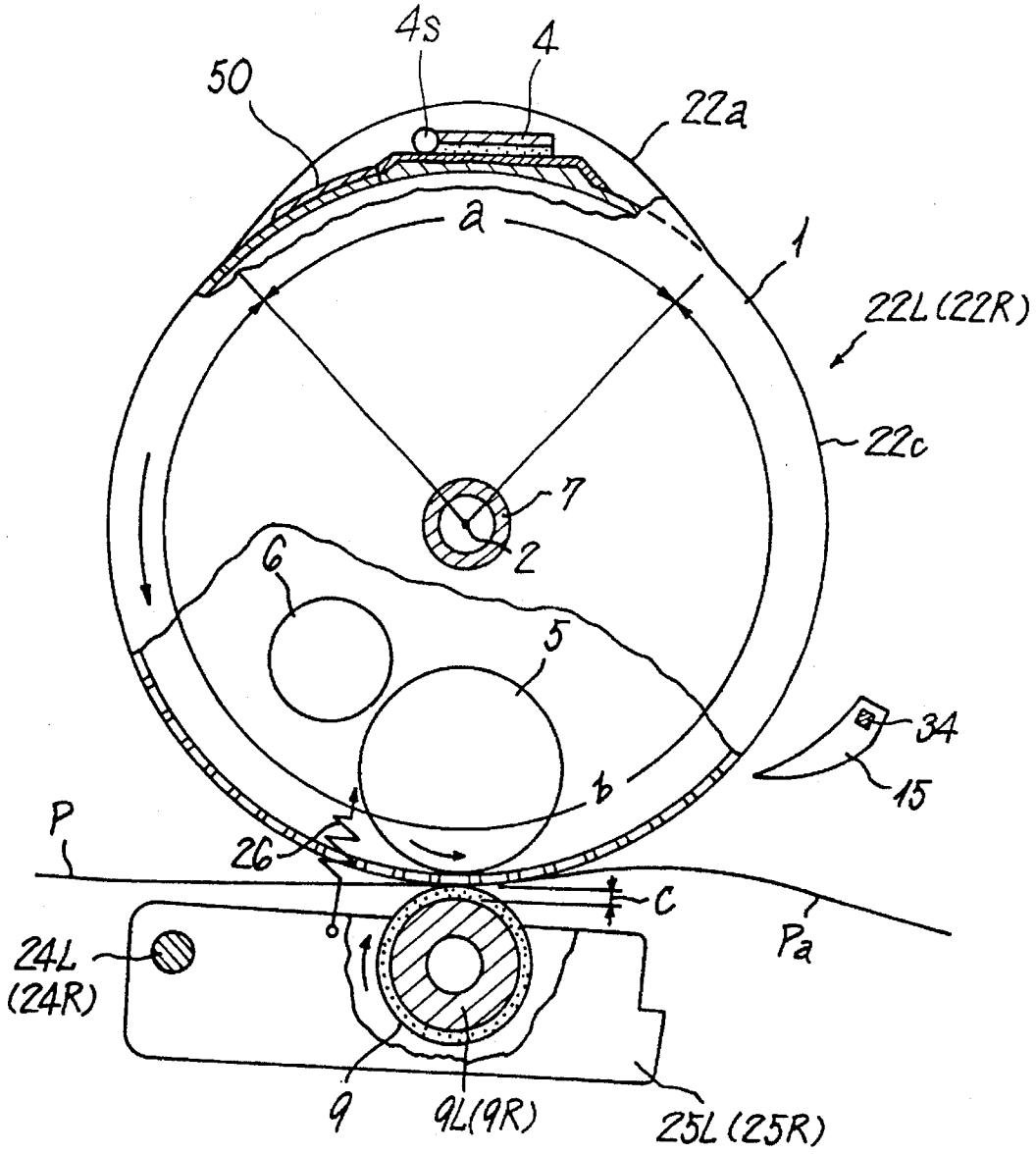
FIG. 3 is a side cross sectional view of the mechanism of FIG. 2 during a printing operation.

As shown in FIG. 1, the printing section 10 includes a clamp 4, an ink supply 8, and a press roller 9 as well as the printing drum 1. The printing drum 1 is rotatable counterclockwise (as shown by the arrow) round a center shaft 2 by a motor (not shown). The clamp 4 functions to hold a leading edge of a stencil 3, is located across a part of the surface of the printing drum 1, and is opened and closed. The ink supply 8 is located in the printing drum 1, and includes an ink supply roller 5 for supplying ink to the inner surface of the printing drum 1, a doctor roller 6 which is juxtaposed with a fine space against the ink roller 6, and an ink supply tube 2 (i.e. center shaft 2). The ink roller 5 and the doctor roller 6 form an ink pool 7 therebetween when ink is supplied thereto via the ink tube 2. The press roller 9 is located below the ink supply roller 5 via the printing drum 1. The press roller 9 is selectively movable between a printing position, where it comes into contact with the printing drum 1 via the printing sheet P, and a non-printing position away from the printing drum 1. At the print position, the press roller 9 is in contact with the printing area b of the printing drum 1 via the printing sheet P as shown in FIG. 3. At the non-printing position, the press roller 9 stays away from the non-printing area a of the printing drum 1, and does not interfere with the clamp 4.

The sheet feeding section 20 includes a sheet feed tray 11 bearing a stack of printing sheets P, a sheet feed roller 12, a pair of sheet separating rollers 13*a* and 13*b*, and a pair of sheet conveying rollers 14*a* and 14*b*. The sheet separating roller pair 13*a* and 13*b* separate each printing sheet P from the sheet stack. The sheet conveying roller pair 14*a* and 14*b* convey each printing sheet P at a preset timing into a space between the outer surface of the printing drum 1 and the press roller 9.

The sheet discharging section 30 comprises a sheet separating pawl 15 for stripping a printed sheet Pa off from the outer surface of the printing drum 1, a sheet separating mechanism 21, and a tray 16 for receiving printed sheets Pa. The sheet separating mechanism 21 includes an endless conveyor belt 19 extending over a pair of rollers 17 and 18 so as to convey the stripped sheet Pa onto the tray 16.

A stencil duplicating machine according to a first embodiment of the invention will be described hereinafter with reference to FIGS. 2 to 6.

Figure 2:
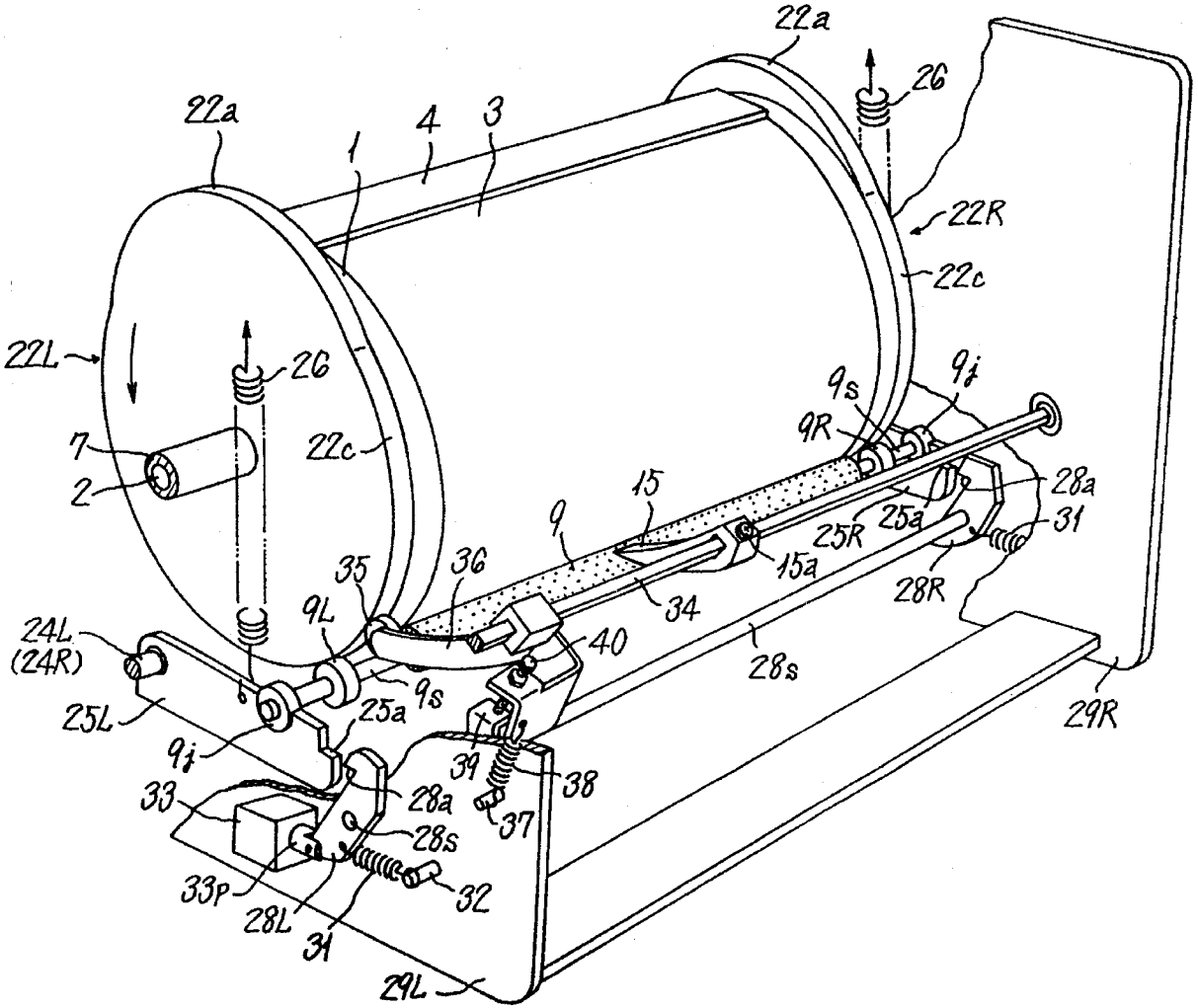
FIG. 2 is a perspective view of a mechanism for contacting and detaching the press roller with and from the printing drum and parts associated therewith, according to a first embodiment of the invention.

Referring to FIG. 2, the printing drum 1 is has a well-known structure, and is implemented as a porous cylindrical member made of stainless steel, and is rotatably supported on the center shaft 2 attached to a pair of side plates 29L and 29R.

As shown in FIG. 3, a screen leather 50 in the strip shape is situated across a part of the outer surface of the printing drum 1 near a clamp shaft 4*s*. The screen leather 50 projects approximately 1 to 2 millimeters from the surface of the printing drum 1, and reinforces a trailing end of a mesh screen wrapped on the printing drum 1.

The printing drum 1 has a pair of cams 22L and 22R at its opposite sides substantially as integral parts, which have the same profile, and are rotatably fitted on the center shaft 2. The cams 22L and 22R are made of plastics, and have base circles 22*c* and large diameter portions 22*a*, respectively. The large diameter portions 22*a* are higher than the clamp 4 on the printing drum 1. The cams 22L and 22R are symmetrically situated in such a manner that they sandwich the clamp 4 between the large diameter portions 22*a* thereof.

Figure 4:
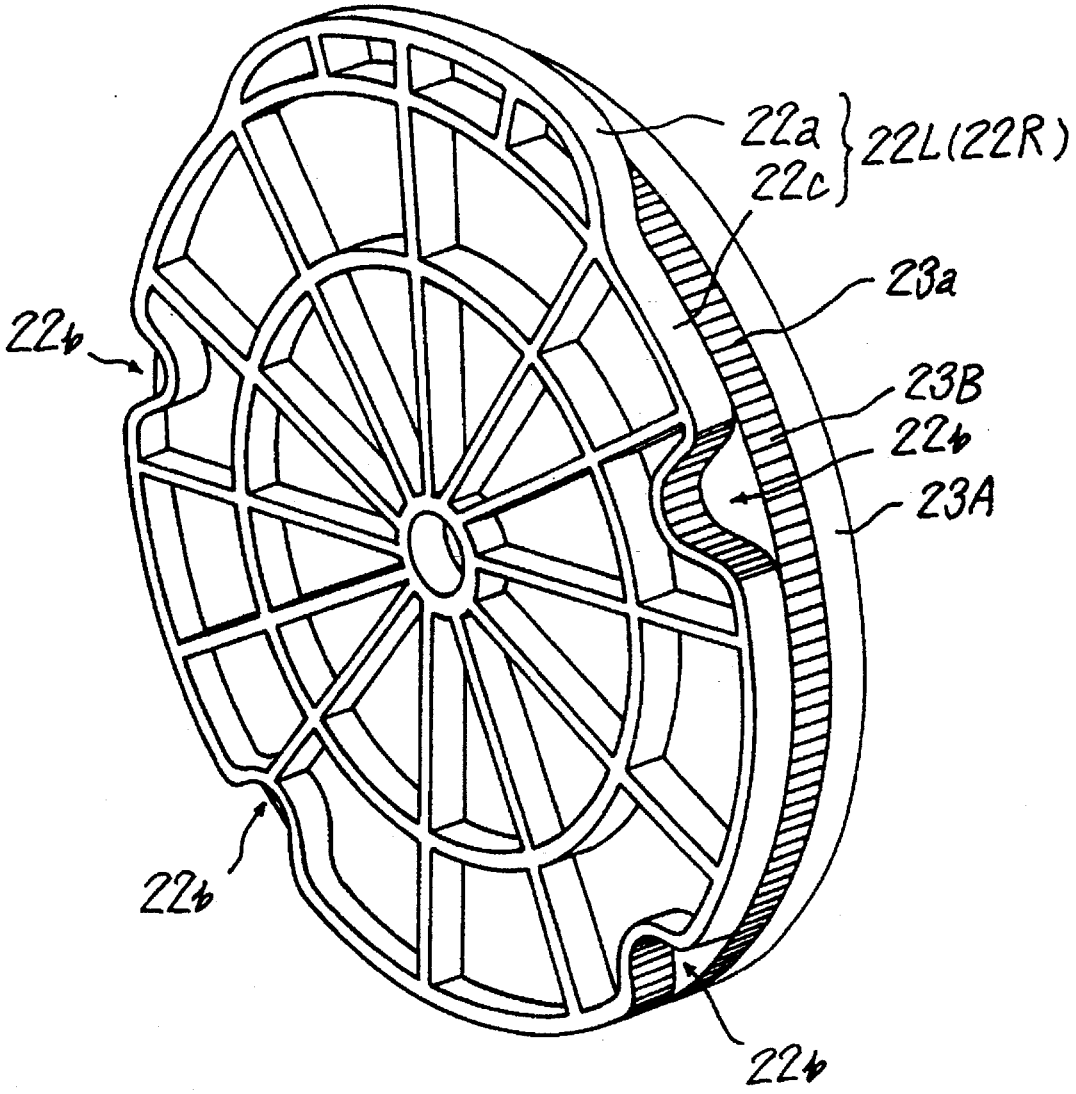
FIG. 4 is a perspective view showing one of cams used in the mechanism of FIG. 2.

Referring to FIG. 3, the large diameter portions 22*a* of the cams 22L and 22R correspond to the non-print area a of the printing drum 1 while the base circles 22*c* thereof correspond to the print area b of the printing drum 1. As shown in FIG. 4, each of the cams 22L and 22R has a plurality of knurled dents 22*b* formed on each base circle 22*c*. These knurled dents 22*b* are used when manually rotating the printing drum 1 so as to remove a jammed stencil or printing sheet, for example. The cam disc 22L (22R) has a flange 23A (23B) on the side thereof which is in contact with a side of the printing drum 1. The flange 23A has a diameter which is substantially as large as that of the printing drum 1. The flange 23B is between the base circle 22*c* of the cam disc 22L (22R) and the flange 23A, and is somewhat larger than the base circle 22*c* of the cam disc 22L (22R) and the flange 23A. The flanges 23A and 23B are made of plastics, and integral with the cam disc 22L (22R). The flange 23B has a knurled peripheral edge 23*a*, so that the printing drum 1 can be manually rotated. The manual rotation of the printing drum 1 can be reliably performed by a well-known mechanism, not shown, including a one-way clutch connected to a drive shaft of the ink supply roller 5 (shown in FIG. 1). The cams 22L and 22R and the flanges 23A have hollow portions so that they are light in weight and contribute to reduce a moment of inertia applied to the printing drum 1 during the rotation thereof. The hollow portions of the flange 23A are not shown in FIG. 4.

As shown in FIG. 2, the press roller 9 is juxtaposed to the center shaft 2 of the printing drum 1, and is a rubber roller of a well-known structure. The press roller 9 is substantially integral with a shaft 9*s*. The shaft 9*s* has cam followers 9L and 9R near its opposite ends outside the press roller 9. The cam followers 9L and 9R are in the same shape, and selectively follow the cams 22L and 22R. Each of the cam followers 9L and 9R has a diameter which is smaller than that of the press roller 9, so that a fine space c (shown in FIG. 3) can be maintained between the printing drum 1 and the cam followers 9L and 9R. Thus, the printing sheet P is pressed to the print area b by the printing drum 1 and the press roller 9 so as to have an image transferred thereon during the printing process.

Referring to FIG. 2, the shaft 9*s* has, at its opposite ends, a pair of bearings 9*j* outside the cam followers 9L and 9R. These bearings 9*j* are received by a pair of press roller arms 25L and 25R, which are in the same shape. Each of the press roller arms 25L and 25R is movably received by a support shaft 24L (24R, not shown in FIG. 2), which is connected to a side plate 29L (29R). Each of the press roller arms 25L and 25R is vertically movable at its free end. Thus, the shaft 9*s* of the press roller 9 is rotatably supported at its opposite ends by the press roller arms 25L and 25R via the bearings 9*j*. Each press roller arm 25L (25R) has a step 25*a* at the free end thereof, which is adapted to be engaged with a pressure releasing ratchet 28L (28R) to be described later.

A pair of spiral tension springs 26 are situated between the centers of the press roller arms 25L and 25R and immovable members (which are disposed on the side plates 29L and 29R, but not shown) above the printing drum 1. Therefore, the press roller arms 25L and 25R are continuously urged upward by the spiral tension springs 26 so that the cam followers 9L and 9R are in pressure contact with the cams 22L and 22R, and so that the press roller 9 is urged to rock toward the outer surface of the printing drum 1. The spiral tension springs 26 are strictly controlled their properties such as a load, a height and a spring constant, so that the press roller 9 can come into contact with the printing drum 1 with a uniform load during the printing process.

Figure 5:
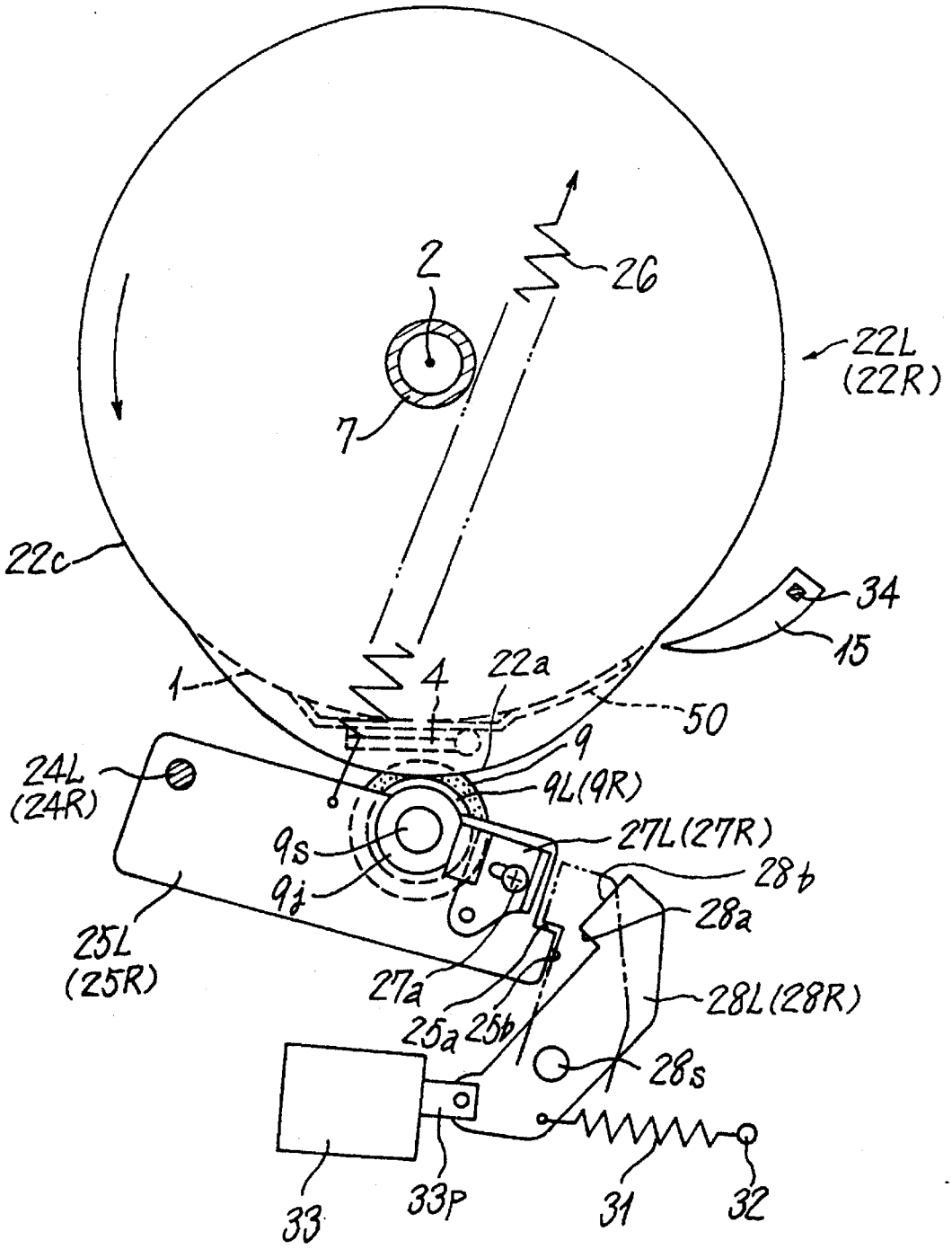
FIG. 5 is a side view showing the mechanism of FIG. 2 during the printing and non-printing operations.
Figure 6A:
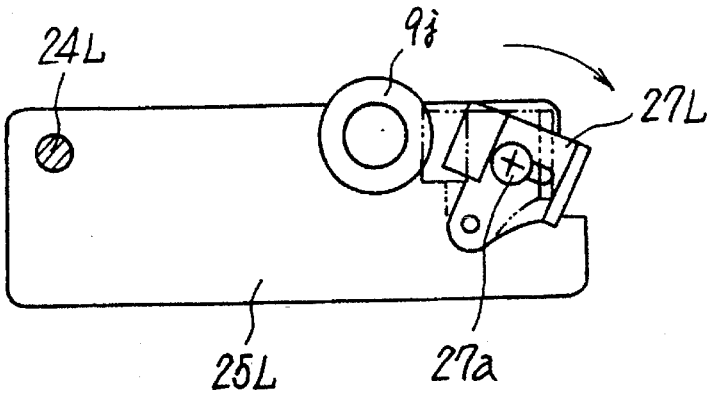
FIG. 6(*a*) and FIG. 6(*b*) are side views showing the configuration and operation of one of press roller bearing holders.
Figure 6B:
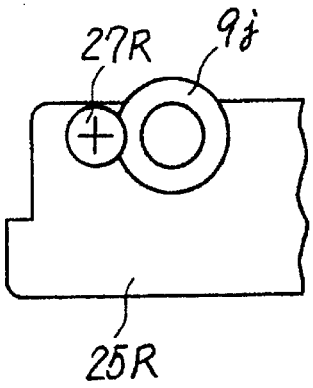

As shown in FIG. 5, the bearings 9*j* of the shaft 9*s* are protected by stops 27L and 27R against falling off from the press roller arms 25L and 25R. Referring to FIG. 6(*a*), the stop 27L has a base serving as a fulcrum, which is attached to the press roller arm 25L. The stop 27L is supported by a stepped screw 27*a* in such a manner that the stop 27L is axially movable in a space between a click position and a non-click position. This mechanism facilitates loading and unloading of the printing drum 1, and replacement and cleaning of parts such as the press roller 9 or tension coil springs 26. FIG. 6(*b*) shows the stop 27R for the press roller arm 25R.

The pressure releasing ratchets 28L and 28R selectively engage with the press roller arms 25L and 25R so as to stop the rocking motion thereof, are near the press roller arms 25L and 25R, and are fixedly fitted on a shaft 28*s* which is rotatably supported on the side plates 29L and 29R. The pressure releasing ratchet 28L (28R) has a toothed portion 28*a* at its free end. The toothed portion 28*a* is adapted to selectively engage with the step 25*a* of the press roller arm 25L (25R). Referring to FIG. 5, a pair of tension coil springs 31 are positioned right to the pressure releasing ratchets 28L and 28R. Each of the tension spring 31 is fitted on a pin 32 embedded in the side plate 29L (29R) at one end thereof, and is connected to the base of the pressure releasing ratchet 28L (28R) at the other end thereof. Each of the tension coil springs 31 urges the toothed portion 28*a* of the pressure releasing ratchet 28L (28R) to the left so that the toothed portion 28*a* is engaged with the step 25*a* of the press roller arm 25L (25R). A pair of solenoids 33 including plungers 33*p* are fixedly situated on the side plates 29L and 29R near the pressure releasing ratchets 28L and 28R. Each of the plungers 33*p* is connected to the base of the pressure releasing ratchet 28L (28R).

The pressure releasing ratchets 28L and 28R, shaft 28*s*, tension coil springs 31 and solenoids 33 serve to hold and free the press roller 9 at and from the non-printing position.

The sheet separating pawl 15 is fastened at its base by a small screw 15*a* on a shaft 34 which rotatably extends between the side plates 29L and 29R, and has a rectangular cross section. The sheet separating pawl 15 has a free end which is selectably movable between a sheet separating position which is close to the outer surface of the printing drum 1 with a minimum space kept against the printing drum, and a non-sheet separating position which is far from the printing drum 1. At the sheet separating position, the separating pawl 15 can reliably strip a leading edge of the printed sheet Pa off from the printing drum 1 without any contact with the outer surface of the printing drum 1. At the non-sheet separating position, the separating pawl 15 does not interfere with the clamp 4.

The shaft 34 includes a drive arm 36 near the side plate 29L. The drive arm 36 includes, as an integral part, a roller 35 which serves as a cam follower for the sheet separating pawl 15 (called "cam follower 35"). A tension coil spring 38 is disposed between the base of the sheet separating arm 36 and a pin 37 embedded in the side plate 29L. The tension spring 38 urges the drive arm 36 so that the cam 22L and the cam follower 35 are continuously in pressure contact with each other. In FIG. 2, reference numeral 39 denotes an L-shaped stop fastened at a predetermined position on the side plate 29L, and 40 denotes a screw in contact with the stop 39. Both the stop 39 and the screw 40 reliably adjust the sheet separating pawl 15 at the sheet separating position. The screw 40 is turned so that the large diameter portion 22*a* of the cam disc 22L is in optimum contact with the cam follower 35 but that the cam follower 35 does not come into pressure contact with the base circle 22*c* (FIG. 3) and the dents 22*b* (FIG. 4) of the cam disc 22L. In other words, the stop 39 and the screw 40 allows the cam follower 35 to selectively contact only with the large diameter portion 22*a* of the cam disc 22L.

The operation of the foregoing stencil duplicating machine will be described hereinafter. Unless otherwise specified, one each of paired components will be described.

Referring to FIG. 1, a printing sheet P is conveyed toward press roller 9 via the sheet feed roller 12, separation roller pair 13*a* and 13*b*, and sheet conveying roller pair 14*a* and 14*b*. The printing sheet P reaches the space between the printing drum 1 and the press roller 9 which are in synchronization with each other. Then, the tension springs 26 enable the press roller 9 to be in uniform pressure contact with the printing drum 1 via the printing sheet P and the stencil 3 wrapped round the printing drum 1. In this state, ink oozes via the perforations of the stencil 3 and is transferred onto the surface of the printing sheet P, thereby forming an image thereon. In this state, the ink supply roller 5 (shown in FIG. 3) also rotates in the same direction as that of the printing drum 1, and supplies ink to the inner surface of the printing drum 1. For simplification, only one of the spiral tension springs 26 is shown in FIG. 3, and the unit for holding and freeing the pressure roller 9 at and from the non-printing position are omitted therefrom. The printed sheet Pa is stripped off from the printing drum 1 by the sheet separating pawl 15, is conveyed on the conveyer belt 19 and is received in the discharge tray 16. Thus, the printing on one sheet is completed.

As shown in FIG. 5, when the printing drum 1 further rotates and the large diameter portion 22*a* of the cam 22L reaches near the press roller 9, the large diameter portion 22*a* of the cam 22L comes into contact with the cam follower 9L. Then, the press roller arm 25L is rocked downward on the fulcrum 24L, so that the press roller 9 is pushed backward from the outer surface of the printing drum 1 against the force of the tension coil spring 26. The press roller 9 remains out of contact with the screen leather 50 and the clamp 4. As the printing drum 1 keeps on rotating, the clamp 4 reaches near the free end of the sheet separating pawl 15, i.e. the non-sheet separating position of the sheet separating pawl 15. Then, the cam follower 35 (FIG. 2) comes into contact with the large diameter portion 22*a* of the cam 22L, turns counterclockwise the shaft 34 for the sheet separating pawl 15, thereby making the free end of the sheet separating pawl 15 leave away from the screen leather 50 and the clamp 4. Thus, the sheet separating pawl 15 does not interfere with the screen leather 50 and the clamp 4. When the printing drum 1 further rotates and the large diameter portion 22*a* of the cam 22L leaves further from the press roller 9, a succeeding sheet will be printed. The foregoing printing process is repeated until a desired amount of printed sheets Pa is produced.

At the end of the printing process, the solenoid 33 which has been active is released while the press roller 9 is pressed to the printing drum 1 via the last printing sheet P (FIG. 3). As shown in FIG. 5, the pressure releasing ratchet 28L moves to a position shown by a dashed line, and comes into contact with a flat part 25*b* of the step 25*a* of the press roller arm 25L via a flat part 28*b* of the toothed portion 28*a* thereof. When the last printed sheet Pa is discharged onto the discharge tray 16, and when the large diameter portion 22*a* of the cam 22L moves downward and comes into pressure contact with the cam follower 9L, the press roller arm 25L is rocked downward on the fulcrum 24L while the flat part 28*b* of the pressure releasing ratchet 28L is in contact with the flat part 25*b* of the press roller arm 25L. Further, when the peak of the large diameter portion 22*a* of the cam 22L reaches near the press roller 9, the step 25*a* of the press roller arm 25L and the toothed portion 28*a* of the pressure releasing ratchet 28L engages with each other as shown by a dashed line. In this state, the press roller arm 25L and the pressure releasing ratchet 28L remain engaged with each other even when the printing drum 1 makes one or more rotations. Thus, the press roller 9 is maintained at the non-print position where it is away from the printing drum 1 and the clamp 4.

In the printing operation, the solenoid 33 is actuated while the printing drum 1 is rotating. When the peak of the large diameter portion 22*a* of the cam 22L moves down and comes into contact with the cam follower 9L, the press roller arm 25L is slightly pushed downward against the force of the tension coil spring 26. Thus, the toothed portion 28*a* of the pressure releasing ratchet 28L leaves from the step 25*a* of the press roller arm 25L. Thereafter, the plunger 33P of the solenoid 33 is withdrawn to displace the pressure releasing ratchet 28L to the position shown by a solid line, thereby disengaging the step 25*a* and the toothed portion 28*a* of the pressure releasing ratchet 28L. The press roller 9 is in pressure contact with the printing drum 1 at the printing area a thereof, and is out of contact with the printing drum 1 at the non-printing area b (refer to FIG. 3).

A second embodiment of the invention will be described with reference to FIGS. 7 to 11. This embodiment is substantially similar to the first embodiment except for the following points. In this embodiment, a stencil duplicating machine is intended for duplication of images on A4 size paper sheets, for example. A printing drum 1 and cams 22L and 22R are smaller than those in the first embodiment, and an arm 136 is used to actuate a sheet separating pawl 15 in place of the arm 36 in the first embodiment.

Figure 7:
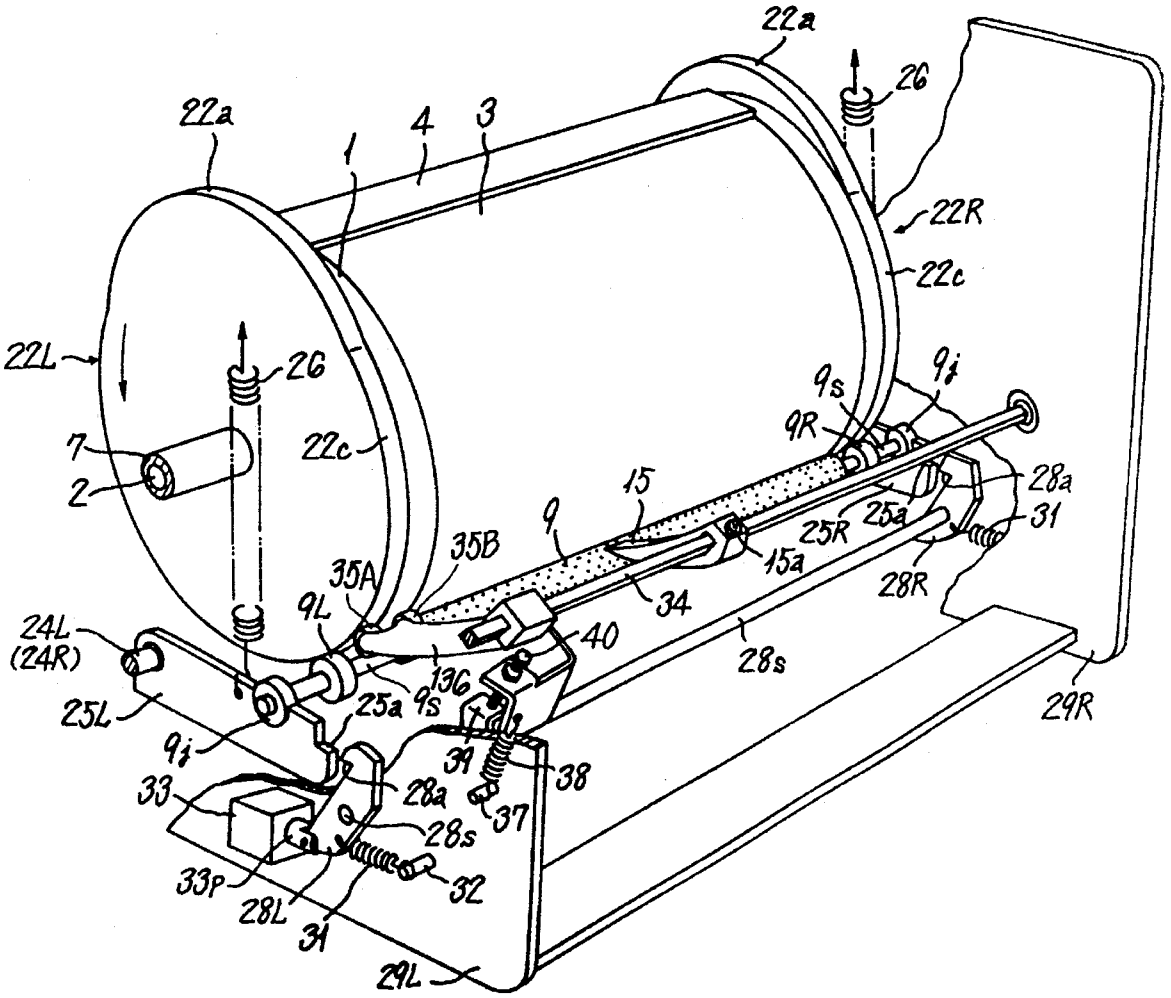
FIG. 7 is a view similar to FIG. 2, but showing a mechanism for actuating a sheet separating pawl and other parts associated therewith in a second embodiment of the invention.

Referring to FIG. 7, the base of the arm 136 is substantially integral with the shaft 34 at the position near the side plate 29L. The arm 136 has, at its free end, rollers 35A and 35B serving as cam followers (called "cam followers 35A and 35B"). The cam follower 35A first comes into contact with the cam 22L, selectively displacing the sheet separating pawl 15 at the sheet separating position and the first non-sheet separating position. In other words, the cam follower 35A keeps the sheet separating pawl 15 away from the screen leather 50. The cam follower 35B comes into contact with the cam 22L after the cam follower 35A, and selectively displaces the sheet separating pawl 15 from the second non-sheet separating position to the sheet separating position, i.e. keeps the sheet separating pawl 15 away from the stencil clamp 4 and returns the pawl 15 to the sheet separating position. The cam followers 35A and 35B are adjacently positioned on the arm 136 so that they come into contact with the cam 22L successively.

A tension coil spring 38 is disposed between the base of the arm 136 and a pin 37 embedded in the side plate 29L, and continuously urges the arm 136 to make the cam follower 35A and/or the cam follower 35B come into contact with the cam 22L.

Figure 8:
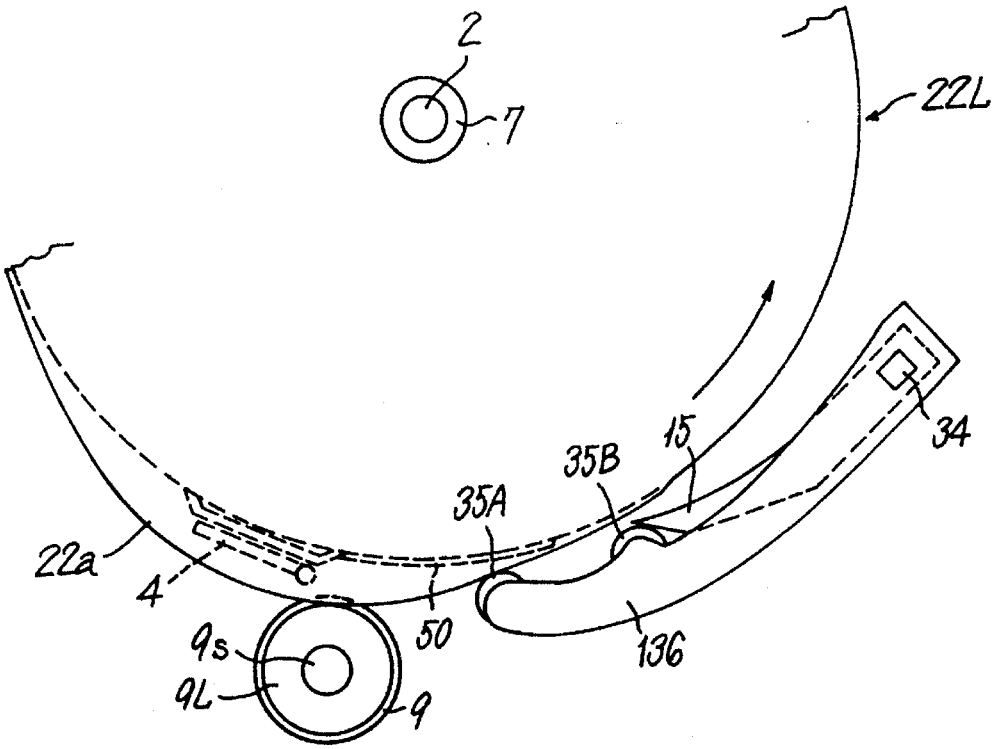
FIG. 8 is a side view showing the state in which a tip of the sheet separating pawl is away from a screen leather on the printing drum.

In operation, the second embodiment differs from the first embodiment as described below. When the printing drum 1 keeps on rotating counterclockwise after the completion of printing on one sheet, the large diameter portion **22*a* of the cam 22L comes down near the press roller 9, i.e. the non-printing position, as shown in FIG. 8. In this state, the cam follower 9L comes into contact with the leading section of the large diameter portion 22*a* of the cam 22L, and the press roller arm 25L is rocked downward on the fulcrum 24L. Then, the press roller 9 leaves away from the outer surface of the printing drum 1 and the screen leather 50 against the force of the tension coil spring 26, so that the press roller 9 does not interfere with the screen leather 50 and the clamp 4**.

After the cam follower 9L, the cam follower 35A comes into contact with the large diameter portion **22*a* of the cam 22L, thereby rocking the arm 136 and turning the sheet separating pawl shaft 34 counterclockwise. Thus, the sheet separating pawl 15 stays at the first non-sheet separating position, does not interfere with the screen leather 50**.

Figure 9:
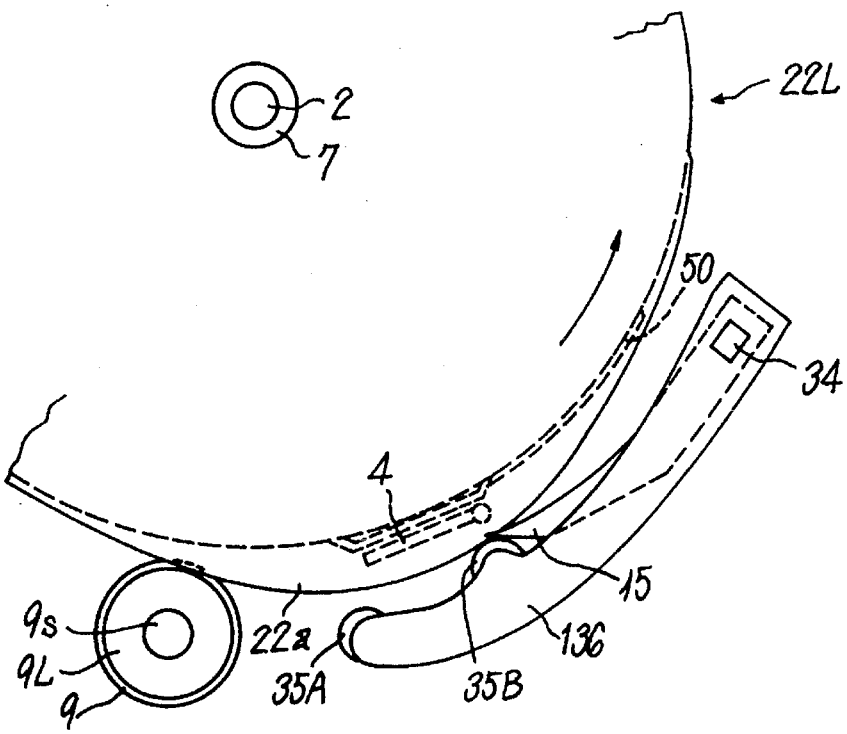
FIG. 9 is a view similar to FIG. 8, but showing the state in which the tip of the sheet separating pawl is away from a clamp
Figure 10:
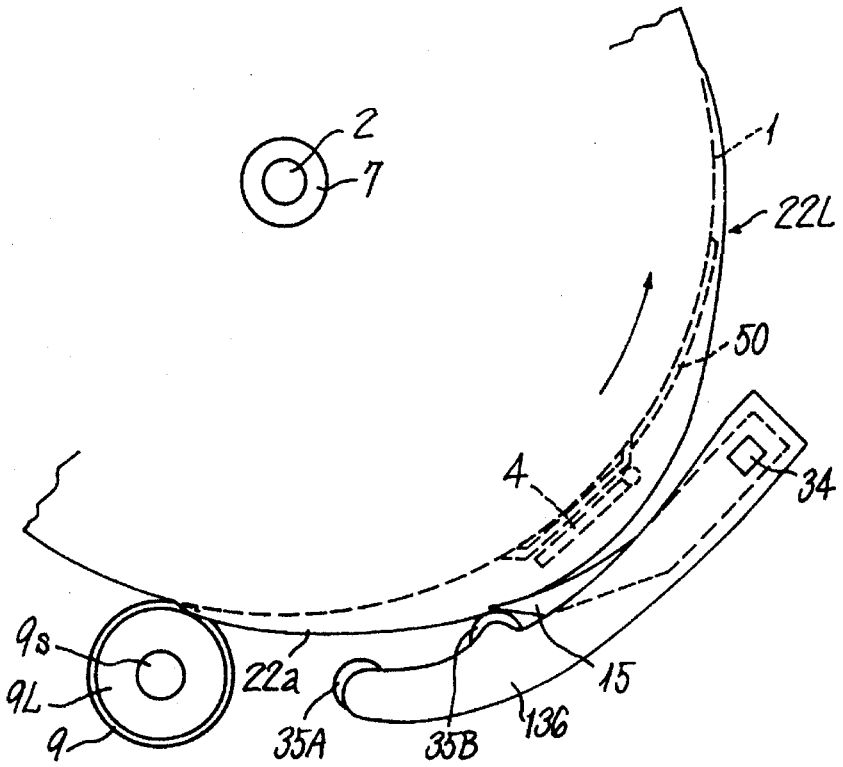
FIG. 10 is a view similar to FIG. 8, but showing the state in which the tip of the sheet separating pawl is further away from the clamp.

As shown in FIG. 9, the printing drum 1 further keeps on rotating, and the clamp 4 arrives near the sheet separating pawl 15. Then, the cam follower 35A leaves away from the large diameter portion **22*a* of the cam 22L while the cam follower 35B comes into contact with the large diameter portion 22*a* of the cam 22L. Thereafter, the arm 136 rocks, and the sheet separating pawl shaft 34 turns counterclockwise, thereby preventing the sheet separating pawl 15 from contacting with the clamp 4**.

when the printing drum 1 further rotates counterclockwise as shown in FIG. 10, the cam follower 35B still remains in contact with the large diameter portion **22*a* of the cam 22L after the clamp 4 goes away from the sheet separating pawl 15. Thus, the arm 136 rocks and the shaft 34 are in counterclockwise rotation, thereby maintaining the sheet separating pawl 15** at the second non-sheet separating position.

Figure 11:
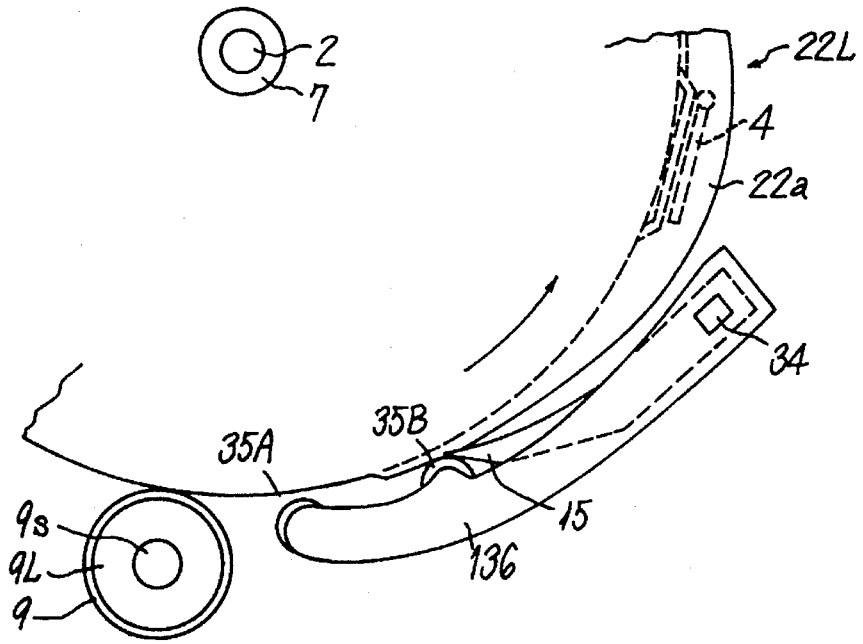
FIG. 11 is a view similar to FIG. 8, but showing the state in which the tip of the sheet separating pawl is going to return to the sheet separating position.

Referring to FIG. 11, when the printing drum 1 further rotates, the trailing end of the large diameter portion **22*a* of the cam 22L reaches near the cam follower 35B. Then, the cam follower 35B comes out of contact from the large diameter portion 22*a* of the cam 22L. Thus, the sheet separating pawl 15** quickly returns to the sheet separating position.

Sequential contacting of the cam followers 35A and 35B with the cam 22L enables the sheet separating pawl 15 to displace itself between the sheet separating position, and the first and second non-sheet separating position in synchronization with the rotation of the printing drum 1.

In the foregoing embodiments, a pair of cams 22L and 22R are positioned at the opposite sides of the printing drum 1 in such a manner that their large diameter portions **22*a* sandwich the clamp 4 on the printing drum 1. Alternatively, one cam may be provided on one side of the printing drum and one cam follower may be arranged at one side of the press roller contacting and detaching mechanism when the press roller bearings 9*j*** are received in a pair of press roller arms having an integral and strong structure.

In the second embodiment, two rollers 35A and 35B function as cam followers, and are used to displace the sheet separating pawl 15 at the first and second non-sheet separating positions. Alternatively, a plurality of cam followers may be used. Further, other members which can come into contact with the cam may be used as the cam followers 35A and 35B,

What is claimed is:

1. A stencil duplicating machine comprising:

a) a printing drum for wrapping a stencil thereon, said printing drum including a center shaft;

b) a press roller selectively movable between a printing position in pressure contact with the printing drum via a printing sheet and a non-printing position away from the printing drum, said press roller including a press roller shaft;

c) at least one press roller arm for rotatably supporting opposite ends of the press roller, the press roller arm performing a rocking motion;

d) a sheet separating pawl selectively movable between a sheet separating position to strip a printed sheet from the outer surface of the printing drum and a non-sheet separating position away from the printing drum;

e) a shaft for fixedly supporting the sheet separating pawl and moving the sheet separating pawl between the sheet separating position and the non-sheet separating position;

f) an arm for selectively displacing the sheet separating pawl at the sheet separating position and the non-sheet separating position, the arm being fitted on the shaft for the sheet separating pawl;

g) at least one cam substantially integral with a side of the printing drum, the cam being coaxially supported on the center shaft of the printing drum, having a large diameter portion at a part thereof, and selectively displacing the press roller at the printing position and the non-printing position;

h) at least one press roller cam follower for the press roller, the press roller cam follower being fitted on the press roller shaft and following the cam;

i) means for urging the press roller cam follower toward the cam;

j) a sheet separating pawl cam follower for the sheet separating pawl, the sheet separating pawl cam follower being fitted on the sheet separating pawl arm and following the cam such that said cam actuates both said press roller cam follower and said sheet separating pawl cam follower; and k) means for urging the sheet separating pawl cam follower toward the cam.

2. A stencil duplicating machine as in claim 1, wherein a pair of cams are provided which have the same profile and are arranged in a manner to have the same phase, and wherein a pair of press roller cam followers are provided so as to follow the pair of cams, a pair of press roller arms are provided, and the means for urging the press roller cam follower urges the press roller arms with a uniform load.

3. A stencil duplicating machine as in claim 1, further including means for holding the press roller at the non-printing position, and means for releasing the press roller holding means from the non-printing position when the press roller moves to the printing position for the printing operation.

4. A stencil duplicating machine comprising:

a) a printing drum for wrapping a stencil thereon, said printing drum including a center shaft;

b) a sheet separating pawl including a tip selectively movable between a sheet separating position to strip a printed sheet from the outer surface of the printing drum and first and second non-sheet separating positions away from the printing drum;

c) a shaft for fixedly supporting the sheet separating pawl and moving the sheet separating pawl between the sheet separating position and non-sheet separating positions;

d) at least one cam coaxially supported on the center shaft of the printing drum;

e) an arm for selectively displacing the sheet separating pawl at the sheet separating position and the first and second non-sheet separating positions, the arm being fitted on the shaft for the sheet separating pawl and including a first cam follower determining a timing at which the tip of said sheet separating pawl begins to move toward the first non-sheet separating position, and a second cam follower determining a timing at which the tip of said sheet separating pawl moves to the second non-sheet separating position and a timing at which said tip returns to said sheet separating position; and f) means for urging the first and second sheet separating pawl cam followers toward the cam.

5. A stencil duplicating machine comprising:

a) a printing drum for wrapping a stencil thereon, said printing drum including a center shaft;

b) a sheet separating pawl selectively movable between a sheet separating position to strip a printed sheet from the outer surface of the printing drum and a non-sheet separating position away from the printing drum;

c) a shaft for fixedly supporting the sheet separating pawl and moving the sheet separating pawl between the sheet separating position and non-sheet separating position;

d) at least one cam coaxially supported on the center shaft of the printing drum;

e) an arm for selectively displacing the sheet separating pawl at the sheet separating position and the non-sheet separating position, the arm being fitted on the shaft for the sheet separating pawl and including a plurality of cam followers adapted to come into contact with the cam on a timed relation with one another; and f) means for urging the sheet separating pawl cam followers toward the cam;

the machine further including a stencil having a leading edge, and wherein the printing drum includes a clamp for holding the leading edge of the stencil on the outer surface of the printing drum, and the plurality of cam followers comprise a cam follower for moving a tip of the sheet separating pawl apart from the stencil and a cam follower for moving the tip of the sheet separating pawl apart from the clamp.

6. The stencil duplicating machine of claim 4, wherein said second non-separating position is radially spaced from said first non-separating position with said second non-separating position farther from said printing drum than said first non-separating position.

7. A stencil duplicating machine as in claim 2, further including means for holding the press roller at the non-printing position, and means for releasing the press roller holding means from the non-printing position when the press roller moves to the printing position for the printing operation.

8. The stencil duplicating machine of claim 3, wherein said means for holding the press roller holds the press roller at the non-printing position regardless of a rotational position of said cam of said printing drum.

9. The stencil duplicating machine of claim 7, wherein said means for holding the press roller holds the press roller at the non-printing position regardless of a rotational position of said cam of said printing drum.

10. A stencil duplicating machine comprising:

a) a printing drum for wrapping a stencil thereon, said printing drum including a center shaft;

b) a press roller selectively movable between a printing position in pressure contact with the printing drum via a printing sheet and a non-printing position away from the printing drum, said press roller including a press roller shaft;

c) at least one press roller arm for rotatably supporting opposite ends of the press roller, the press roller arm performing a rocking motion;

d) a sheet separating pawl selectively movable between a sheet separating position to strip a printed sheet from the outer surface of the printing drum and a non-sheet separating position away from the printing drum;

e) a shaft for fixedly supporting the sheet separating pawl and moving the sheet separating pawl between the sheet separating position and the non-sheet separating position;

f) an arm for selectively displacing the sheet separating pawl at the sheet separating position and the non-sheet separating position, the arm being fitted on the shaft for the sheet separating pawl;

g) at least one cam substantially integral with a side of the printing drum, the cam being coaxially supported on the center shaft of the printing drum, having a large diameter portion at a part thereof, and selectively displacing the press roller at the printing position and the non-printing position;

h) at least one cam follower for the press roller, the cam follower being fitted on the press roller shaft and following the cam;

i) means for urging the press roller cam follower toward the cam;

j) a cam follower for the sheet separating pawl, the cam follower being fitted on the sheet separating pawl arm and following the cam;

k) means for urging the sheet separating pawl cam follower toward the cam; and l) an adjusting mechanism including a stop and a screw for adjusting a position of said sheet separating pawl at said sheet separating position.

11. A stencil duplicating machine comprising:

a) a printing drum for wrapping a stencil thereon, said printing drum including a center shaft;

b) a press roller selectively movable between a printing position in pressure contact with the printing drum via a printing sheet and a non-printing position away from the printing drum, said press roller including a press roller shaft;

c) at least one press roller arm for rotatably supporting opposite ends of the press roller, the press roller arm performing a rocking motion;

d) a sheet separating pawl selectively movable between a sheet separating position to strip a printed sheet from the outer surface of the printing drum and a non-sheet separating position away from the printing drum;

e) a shaft for fixedly supporting the sheet separating pawl and moving the sheet separating pawl between the sheet separating position and the non-sheet separating position;

f) an arm for selectively displacing the sheet separating pawl at the sheet separating position and the non-sheet separating position, the arm being fitted on the shaft for the sheet separating pawl;

g) at least one cam substantially integral with a side of the printing drum, the cam being coaxially supported on the center shaft of the printing drum, having a large diameter portion at a part thereof, and selectively displacing the press roller at the printing position and the non-printing position;

h) at least one cam follower for the press roller, the cam follower being fitted on the press roller shaft and following the cam;

i) means for urging the press roller cam follower toward the cam;

j) at least first and second cam followers disposed on said sheet separating pawl arm and following the cam, wherein said first and second cam followers are spaced from one another on said sheet separating pawl arm such that movement of said sheet separating pawl arm is controlled by said first cam follower during a first portion of cam rotation, and by said second cam follower during a second portion of cam rotation; and k) means for urging the sheet separating pawl cam follower toward the cam.

12. The stencil duplicating machine of claim 1, further including a bearing rotatably supporting said press roller on said at least one press roller arm, and wherein said at least one press roller arm is mounted upon a shaft and pivots about said shaft to perform said rocking motion, and wherein said at least one press roller cam follower includes a roller member concentrically mounted upon said press roller shaft.

13. The stencil duplicating machine of claim 12, wherein said roller member has a diameter smaller than a diameter of said press roller.

14. The stencil duplicating machine of claim 5, further including a screen leather disposed adjacent to said clamp of said printing drum, and wherein said cam follower for moving the tip of the sheet separating pawl apart from the stencil moves the tip of the sheet separating pawl apart from the screen leather.

* * * * *

UNITED STATES PATENT AND TRADEMARK OFFICE

CERTIFICATE OF CORRECTION

PATENT NO. : 5,454,308

DATED : October 3, 1995

INVENTOR(S) : TAKUO SATO ET AL

It is certified that error appears in the above-indentified patent and that said Letters Patent is hereby corrected as shown below:

In column 3, line 67, after "clamp" insert --.--.

In column 5, line 3, delete "is".

In column 9, line 45, change "when" to --When--.

In column 10, line 14, change "35B," to --35B.--.

Signed and Sealed this

First Day of October, 1996

Bruce Lehman

*Attest:*

BRUCE LEHMAN

*Attesting Officer*

*Commissioner of Patents and Trademarks*